US006074189A

United States Patent [19]

Eckerle

[11] Patent Number: 6,074,189

[45] Date of Patent: Jun. 13, 2000

[54] FILLING MEMBER-LESS INTERNAL-GEAR MACHINE

[76] Inventor: Otto Eckerle, Am Bergwald 6, 76316 Malsch, Germany

[21] Appl. No.: 08/987,001

[22] Filed: Dec. 8, 1997

[30] Foreign Application Priority Data

Dec. 12, 1996 [DE] Germany ..... 196 51 683

[51] Int. Cl.[7] ..... F01C 19/00

[52] U.S. Cl. ..... 418/109; 418/132; 418/166; 418/171; 418/189; 418/108

[58] Field of Search ..... 418/109, 132, 418/166, 171, 189, 108

[56] References Cited

U.S. PATENT DOCUMENTS

| | | | |
|---|---|---|---|
| 1,442,828 | 1/1923 | Rotermund . | |
| 1,460,487 | 7/1923 | Hawkins . | |
| 1,700,818 | 2/1929 | Wilsey . | |
| 1,719,639 | 7/1929 | Wilsey . | |
| 1,719,640 | 7/1929 | Wilsey . | |
| 1,970,146 | 8/1934 | Hill . | |
| 1,990,750 | 2/1935 | Pigott . | |
| 2,076,664 | 4/1937 | Nichols . | |
| 2,132,813 | 10/1938 | Wahlmark . | |
| 2,246,279 | 6/1941 | Wishart . | |
| 2,291,354 | 7/1942 | Sibley . | |
| 2,340,787 | 2/1944 | Zenner et al. . | |
| 2,380,783 | 7/1945 | Painter . | |
| 2,405,061 | 7/1946 | Shaw . | |
| 2,502,173 | 3/1950 | Potts . | |
| 2,600,477 | 6/1952 | Burt . | |
| 2,654,532 | 10/1953 | Nichols . | |
| 2,787,963 | 4/1957 | Dolan et al. . | |
| 2,792,788 | 5/1957 | Eames, Jr. . | |
| 2,809,595 | 10/1957 | Adams et al. . | |
| 2,823,615 | 2/1958 | Haberland . | |
| 3,034,446 | 5/1962 | Brundage . | |
| 3,034,447 | 5/1962 | Brundage | 418/171 |
| 3,034,448 | 5/1962 | Brundage | 418/171 |
| 3,198,127 | 8/1965 | Brundage | 418/171 |
| 3,551,079 | 12/1970 | Brundage . | |
| 4,013,388 | 3/1977 | Stratman | 418/171 |
| 4,200,427 | 4/1980 | Binger et al. . | |
| 4,413,960 | 11/1983 | Specht | 418/171 |
| 4,472,123 | 9/1984 | Eckerle et al. . | |
| 4,619,588 | 10/1986 | Moore, III . | |
| 4,642,030 | 2/1987 | Friebe et al. . | |
| 4,673,342 | 6/1987 | Saegusa . | |
| 4,944,662 | 7/1990 | Child | 418/171 |
| 4,978,282 | 12/1990 | Fu et al. . | |
| 5,090,883 | 2/1992 | Krauter et al. . | |
| 5,122,039 | 6/1992 | Tuckey . | |
| 5,219,277 | 6/1993 | Tuckey . | |
| 5,242,286 | 9/1993 | Arbogast et al. | 418/171 |

FOREIGN PATENT DOCUMENTS

| | | | |
|---|---|---|---|
| 1127162 | 12/1956 | France . | |
| 61-232395 | 10/1986 | Japan . | |
| 587684 | 5/1947 | United Kingdom . | |
| 963736 | 7/1964 | United Kingdom | 418/168 |
| 1233 376 | 5/1971 | United Kingdom . | |
| 1358051 | 6/1974 | United Kingdom . | |

*Primary Examiner*—Thomas Denion
*Assistant Examiner*—Thai-Ba Trieu
*Attorney, Agent, or Firm*—Hoffmann & Baron, LLP

[57] ABSTRACT

A filling member-less internal-gear unit has a casing with a bearing ring which is accommodated movably in a bore in the casing transversely with respect to its axis but non-rotatably. An internally toothed annular gear is rotatably mounted in the bearing ring and meshes with a pinion rotatably mounted in the casing. The bearing ring is pivotable relative to the bore in the casing about a pivot axis parallel to its axis. The pivot axis is so disposed that the ring portion of the bearing ring, which is associated with the engagement-free annular gear region, is moved at least approximately radially towards the pinion axis by the hydraulic pressure forces acting on the annular gear in the pressure chamber.

20 Claims, 7 Drawing Sheets

Fig. 1
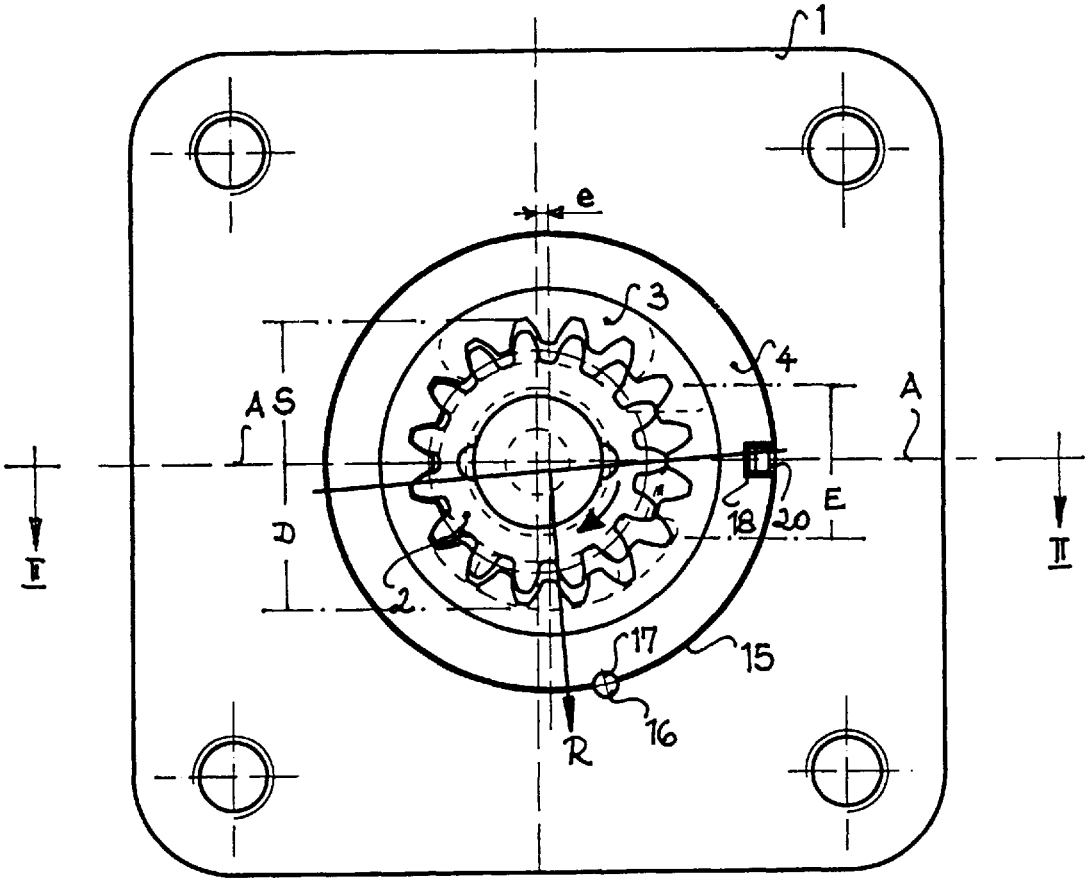
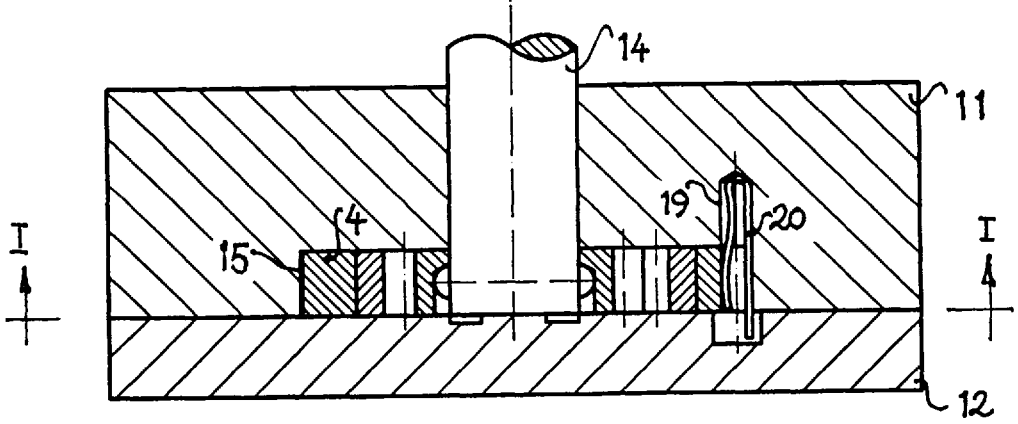
Fig. 2

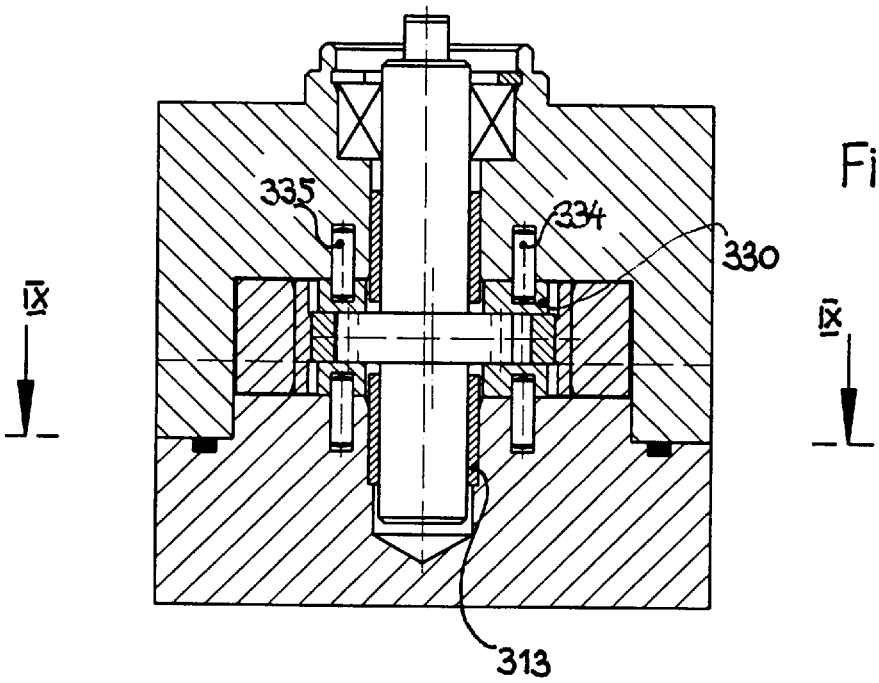
Fig.8
Fig.9
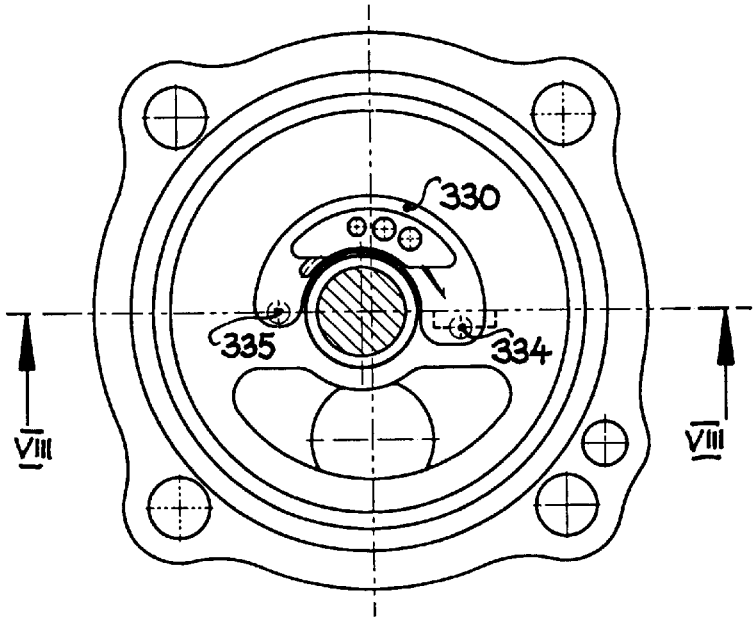

Fig. 10
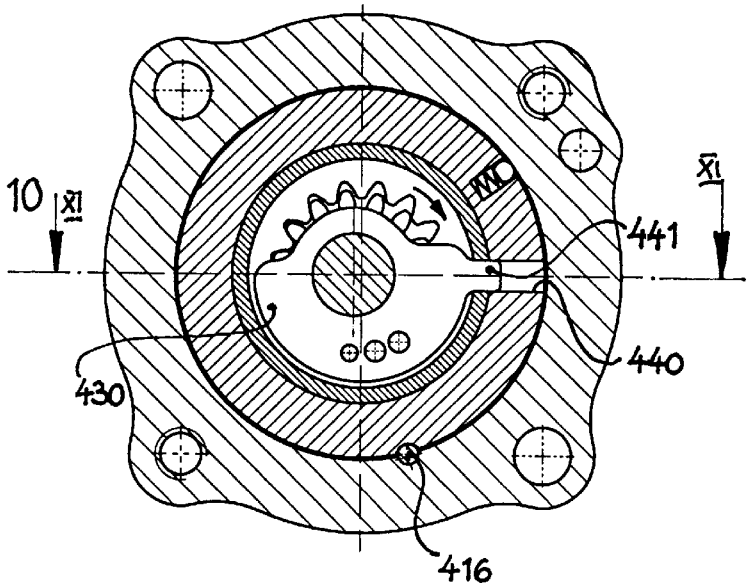
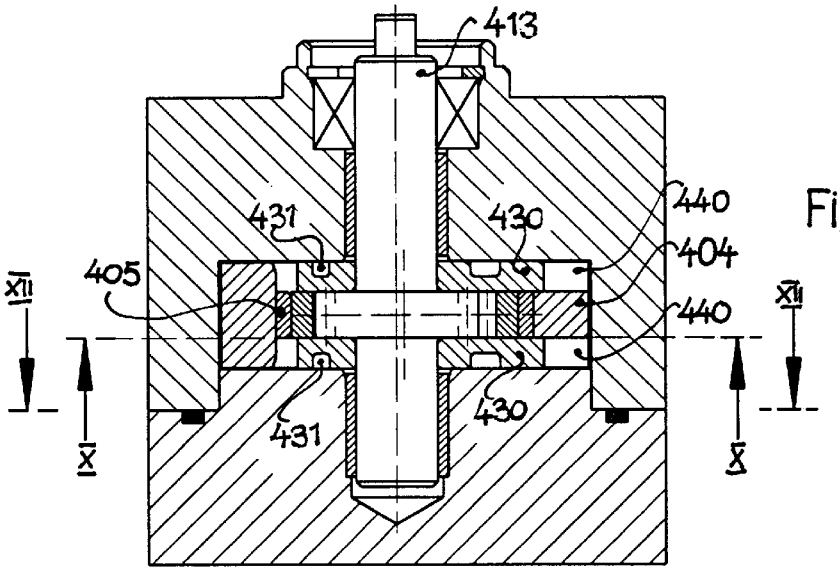
Fig. 11
Fig. 12
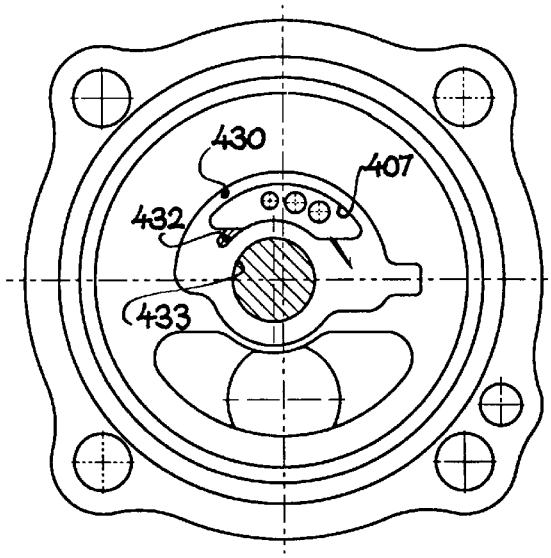

FILLING MEMBER-LESS INTERNAL-GEAR MACHINE

FIELD OF THE INVENTION

The invention concerns a filling member-less internal-gearmachine.

BACKGROUND OF THE INVENTION

A typical form of an internal-gear pump without a filling member therein comprises a casing with a bearing ring accommodated in a bore in the casing movably transversely with respect to its axis but non-rotatably. An internally toothed annular gear is mounted rotatably in the bearing ring; a pinion which is rotatably mounted in the casing has its teeth meshing with the annular gear, defining a suction chamber and a pressure chamber. In an internal-gear pump of that kind, as is to be found in DE 195 17 296 A1, the bearing ring in which the annular gear rotates is accommodated in the bore in the casing, with a radial play of about 0.2 mm. The bearing ring is movable transversely to its axis, to the extent of that radial play, but the bearing ring is prevented from rotating by means of a stud bolt which is disposed on the suction or intake side of the casing. Provided on the pressure or discharge side of the casing in the wall of the bore in the casing is a shallow recess in which is defined a number of pressure areas which communicate with the pressure or discharge chamber defined by the tooth arrangement, by way of radial openings in the bearing ring and radial openings in the annular gear.

The pressure forces prevailing in the pressure chamber of the tooth arrangement have the effect that the annular gear seeks to move away from the pinion. That gives rise to the tendency that the sealing contact which exists to delimit the pressure chamber from the suction or intake chamber, as between the tips of the teeth of the pinion and the annular gear in an engagement-free region of the annular gear in which the teeth of the pinion have come practically completely out of the gaps between the teeth of the annular gear, decreases or is entirely lost. That tendency however is resisted by the pressure force which is produced by the pressure areas and which causes the bearing ring and together therewith the annular gear to be displaced towards the suction side, within the limits of the above-mentioned available radial play. By virtue of that mobility of the bearing ring with the annular gear, the sealing contact as between the tips of the teeth of the pinion and the annular gear is maintained, proportionally to the pressure obtaining on the pressure side.

The provision of pressure areas in a recess in the casing and communicating same to the pressure chamber of the tooth arrangement of the assembly is relatively complicated and therefore increases the manufacturing costs of the internal-gear machine such as a pump. Furthermore the openings which are provided in the bearing ring on the pressure side and by way of which pressure is applied to the pressure areas form a non-homogeneity in regard to the loading on and the deformation of the bearing ring, and that can have an adverse effect on the rotary movement of the annular gear in the bearing ring.

SUMMARY OF THE INVENTION

An object of the present invention is to provide an internal-gear machine such as a pump which is of a simpler configuration, while performing satisfactorily.

Still another object of the present invention is to provide a filling member-less internal-gear machine so designed that pressure forces obtaining within the machine are utilized to improve operation of the machine without involving structural complications.

Still another object of the present invention is to provide a filling member-less internal-gear machine which involves a self-adjusting action in relation to operating conditions within the machine.

In accordance with the principles of the present invention the foregoing and other objects are attained by a filling member-less internal-gear unit comprising a casing, with a bearing ring accommodated in a bore in the casing movably transversely with respect to its axis but non-rotatably. An internally toothed annular gear is mounted rotataby in the bearing ring and a pinion which is rotatably mounted in the casing has teeth meshing with the annular gear, defining a suction chamber and a pressure chamber in the tooth arrangement, by virtue of full engagement of the pinon teeth into gaps between the teeth of the annular gear on the one hand and sealing contact with the tips of the teeth of the annular gear in an engagement-free annular gear region which is approximately diametrally opposite the region of engagement of the pinion teeth into the gaps between the annular gear teeth on the other hand. The bearing ring is pivotable relative to the bore in the casing about a pivot axis which is parallel to its axis. The pivot axis is arranged in such a way that the ring portion of the bearing ring which is associated with said engagement-free annular gear region is moved at least approximately radially towards the axis of the pinion, only by the pressure forces acting in the pressure chamber on the annular gear.

As will be seen in greater detail from an embodiment of the present invention described hereinafter with reference to the drawing the construction of the internal-gear unit of the invention is also such that the bearing ring is accommodated in the bore in the casing with a radial play or clearance, for example of 0.2 mm, but is not displaceable therein, being pivotable within the bore in the casing about a pivot axis which is parallel to the axis of the bearing ring.

The pivot axis is so disposed that on the one hand the ring portion associated with the engagement-free annular gear region, and therewith the engagement-free annular gear region itself, moves as radially as possible, with respect to the axis of the pinion, when the bearing ring performs its pivotal movement. In that way, the tips of the teeth of the pinion and the annular gear are urged against each other to provide sealing contact in the engagement-free annular gear region. Such a direction of movement is best achieved if, with respect to the engagement-free annular gear region, the pivot axis is displaced roughly approximately through a right angle, on the periphery of the assembly. On the other hand however the pivot axis must also be disposed relative to the resultant of the hydraulic forces obtaining in the pressure chamber, in such a way that that resultant produces about the pivot axis a rotational moment which causes the tips of the teeth of the pinion and the annular gear to approach each other in the engagement-free annular gear region.

In a preferred feature of the invention therefore the most advantageous position for the pivot axis is disposed on the side of the pressure chamber between the line of the resultant of the hydraulic forces and the ring portion of the bearing ring, which is associated with the engagement-free region of the annular gear.

In a particularly preferred feature of the invention the pivot axis is disposed closer to the line of the resultant, than to the ring portion associated with the engagement-free annular gear region.

Unlike the known internal-gear pump described in the opening part of this specification therefore there is no need for a pressure area which acts on the bearing ring and by which the bearing ring together with the annular gear is supported in relation to the forces obtaining in the pressure chamber in order to maintain the sealing contact, which is afforded by virtue of the geometry of the tooth configuration, as between the tips of the teeth in the engagment-free annular gear region. On the contrary, the pressure forces prevailing in the pressure chamber are themselves utilized to pivot the bearing ring about the pivot axis by way of the annular gear, in such a fashion that the engagement-free annular gear region is re-adjusted in an appropriate fashion and the sealing contact is maintained proportionally to the magnitude of the pressure forces involved.

The pivotal mounting for the bearing ring can be implemented in different ways, for example by mounting projections which are provided on the bearing ring itself and which engage into corresponding recesses in the casing. In accordance with a preferred feature of the invention, involving a more advantageous and simpler construction however the pivotal mounting for the bearing ring is afforded by a mounting pin which is fixed in the casing and which is accommodated with a portion of its peripheral surface as a bearing surface in an axial groove at the outside periphery of the bearing ring. As the bearing ring is urged with the axial groove against the mounting pin by the forces obtaining in the pressure chamber, in this construction as outlined above, the partially cylindrical axial groove is so matched in terms of its dimensions to the mounting pin that the pressure in relation to surface area is as uniform as possible. At the same time the mounting pin prevents the bearing ring from turning in the bore in the casing.

It will be noted that the above-described internal-gear machine, in a simple embodiment thereof, can be of such a configuration that the pinion, the annular gear and the bearing ring bear directly sealingly with their respective faces against walls of the casing. In order however to enhance the level of efficiency the internal-gear machine such as a pump may have axial plates or disks which are held by pressure areas in sealing contact with the end faces of at least the pinion and the annular gear. The pressure areas can be provided in the casing walls and/or in the faces of the axial plates or disks, which are remote from the tooth configurations of the pinion and the annular gear.

A further increase in the level of efficiency of the internal-gear machine according to the invention which has axial plates or disks can be achieved if the unit is of such a configuration as to provide that the axial plates or disks, together with the bearing ring and the annular gear, can perform the desired compensating movement for maintaining the sealing contact between the tips of the teeth. For, that design configuration can then ensure that control of the hydraulic pressure conditions in the pressure and suction chambers respectively, which is effected in known manner by means of control or pre-filling slots in the axial disks or plates, remains at the optimum irrespective of the movements of the annular gear and the bearing ring.

Further objects, features and advantages of the invention will be apparent from the following description of preferred embodiments of a machine according to the invention such as a pump.

BRIEF DESCRIPTION OF THE DRAWING

FIG. 1 is a view of a first embodiment of a machine in the form of a pump according to the invention in cross-section taken along line I—I in FIG. 2, FIG. 2 is a view in axial section taken along line II—II in FIG. 1, FIG. 8 is a view of a fourth embodiment of a pump according to the invention in axial section similarly to FIG. 4, FIG. 9 is a view in cross-section corresponding to FIG. 5 taken along line IX—IX in FIG. 8, FIG. 10 is a view of a fifth embodiment of a pump according to the invention in cross-section taken along line X—X in FIG. 11, FIG. 11 is a view in axial section taken along line XI—XI in FIG. 10, FIG. 12 is a view in cross-section corresponding to FIG. 5 taken along line XII—XII in FIG. 11.

DESCRIPTION OF THE PREFERRED EMBODIMENTS

Figure 3:
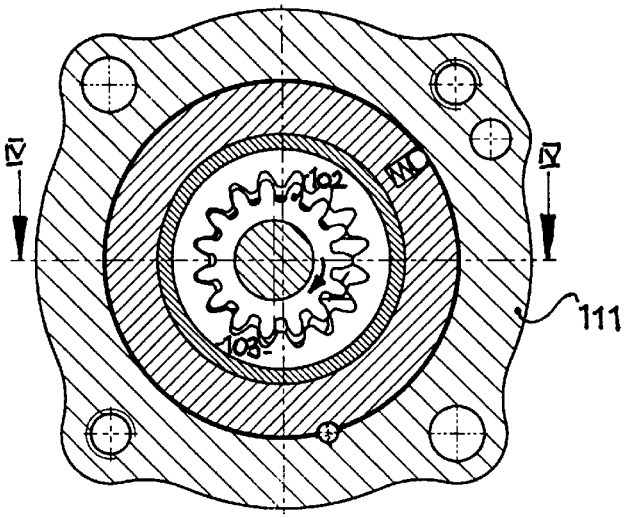
FIG. 3 is a view of a second embodiment of a pump according to the invention in cross-section taken along line III—III in FIG. 4.

Referring to FIGS. 1 and 2 of the accompanying drawing a filling member-less internal-gear unit according to the invention includes a casing which is generally identified by reference numeral and which is made up of a cup-shaped casing portion 11 and a casing cover or end plate portion 12 which is fixed to the end face of the casing portion 11. A pinion shaft 14 is rotatably mounted in the cup-shaped casing portion 11, with a pinion 2 being non-rotatably fixed on the pinion shaft 14. The pinion 2 has its teeth meshing with an internally toothed annular gear 3 which is accommodated in a bearing ring 4 and mounted rotatably therein. As can be seen more particularly from FIG. 1 the pinion 2 and the annular gear 3 are mounted eccentrically relative to each other, with a degree of eccentricity indicated at e. The eccentricity e, that is to say the distance between the axis of the pinion 2 and the axis of the annular gear 3, corresponds to the theoretical tooth configuration geometry of the pinion 2 and the annular gear 3 and presupposes that the tooth configurations roll or slide against each other without play.

The tooth configurations of the pinion 2 and the annular gear 3 mesh with each other in such a way that, on the left-hand side in FIG. 1, in the region of the separating line indicated at A, the teeth of the pinion 2 fully engage into the gaps between the teeth of the annular gear 3 and bear against the tooth flanks, while on the opposite right-hand side in FIG. 1, the teeth of the pinion 2 have come completely out of the gaps between the teeth of the annular gear 3. That region of the annular gear 3 in which no engagement between the teeth of the pinion 2 and the annular gear 3 exists is identified by reference E in FIG. 1 and is referred to herein as the engagement-free annular gear region E. It will be seen therefore that in that engagement-free annular gear region E, a plurality of the tips of the teeth of the pinion 2 and the annular gear 3 successively bear against each other in the course of the rotary movement of the components. It will be seen that in the illustrated embodiment, the tips of three teeth on the pinion 2 are in sealing contact against the tips of three teeth of the annular gear 3. The numbers of teeth and the geometries of the mutually meshing tooth arrangements are so selected that this kind of meshing engagement can occur.

It will be seen that, in this illustrated embodiment, the tooth flanks are in the form of involute curves, with the tips of the teeth being rounded off to provide for a rolling and sliding contact, for the purposes of affording a sealing effect. The number of teeth on the annular gear 3 differs by one from the number of teeth on the pinion 2.

When the pinion 2 rotates in the direction indicated by the arrow in FIG. 1, starting from a condition in which the teeth on the pinion 2 are fully engaged into the teeth of the annular gear 3, above the separating line A, the space defined by the gaps between the teeth of the components increasingly enlarges until the condition shown in FIG. 1 is reached, upon again passing across the separating line A, at the right-hand side in FIG. 1. In that way, the suction or intake chamber as indicated at S of the internal-gear pump is formed. Beneath the separating line A, the free space defined by the gaps between the teeth increasingly reduces again so that this forms the pressure chamber D. The suction chamber S and the pressure chamber D are indicated in terms of their projection in FIG. 1, but it will be appreciated that the suction chamber S and the pressure chamber D each extend in the peripheral direction within the tooth configuration.

The bearing ring 4 is accommodated in a bore 15 in the casing and more specifically in the cup-shaped casing portion 11, with a radial play of about 0.2 mm. A mounting pin 16 partially passes through the wall of the bore 15 in the casing, and is fixedly pressed into the bottom of the bore 15. The substantially semicylindrical portion of the mounting pin 16 which projects beyond the wall of the bore 15 in the casing is accommodated in an axially directed groove 17 in the outside peripheral surface of the bearing ring 4. The axial groove 17 is matched to the shape of the mounting pin 16 and is thus also part-cylindrical.

The mounting pin 16 which engages into the axial groove 17 forms for the bearing ring 4 a pivot axis which extends parallel to the axes of the pinion 2 and the annular gear 3 and about which the bearing ring 4 is pivotable in the bore 15 in the casing, within the limits of the above-mentioned available radial play. As can be seen from FIG. 1, the above-mentioned pivot axis is disposed in a quadrant of the bearing ring 4 which extends between the engagement-free annular gear region E and the middle of the pressure chamber D. In the illustrated embodiment the pivot axis is disposed at an angular spacing of about 80° from the apex point of the engagement-free annular gear region E. At that apex point, two teeth of the pinion 2 and the annular gear 3 bear against each other, with the tips of the teeth substantially aligned with each other.

Having described the structure of the internal-gear pump according to the invention with reference to FIGS. 1 and 2, the mode of operation thereof will now be described.

When the pinion 2 rotates in the direction of rotation indicated by the arrow, a medium to be conveyed by the pump is introduced through a suction or intake passage (not shown) into the suction chamber S between the tooth configurations of the pinion 2 and the annular gear 3 respectively. The medium to be conveyed is urged out of the pressure chamber D under an elevated pressure through a pressure passage (not shown). The structure in this respect of an internal-gear pump is adequately known and therefore does not need to be described in greater detail herein.

The pressure forces obtaining in the pressure chamber D, as between the mutually meshing tooth configurations of the pinion 2 and the annular gear 3, act along a resultant as indicated at R in FIG. 1 in such a way that the annular gear 3 seeks to move away from the pinion 2, in other words, the tendency is that the contact which exists by virtue of the teeth geometry, as between the teeth of the pinion 2 and the annular gear 3, in particular the sealing contact between the tips of the teeth in the engagement-free annular gear region E, is lost. The pivot axis of the bearing ring 4, which is formed by the mounting pin 16 and the engagement thereof into the axial groove 17, is however closer to the engagement-free annular gear region E than the line of the resultant R. As the resultant R acts on the bearing ring 4 by way of the annular gear 3, there is therefore a rotational movement about the pivot axis 16 and 17 in the counter-clockwise direction in FIG. 1. That rotational moment causes the bearing ring 4 to be pivoted about the pivot axis 16, 17, whereby the portion of the ring corresponding to the engagement-free annular gear region E is moved approximately radially with respect to the axis of the pinion 2 and towards same. Consequently, in the engagement-free annular gear region E, the tips of the teeth of the pinion 2 and the annular gear 3 are moved towards each other with a force which is proportional to the magnitude of the resultant R. That maintains the sealing contact in that region of the meshing tooth configurations, proportionally to the pressure involved.

At a location associated with the apex point of the engagement-free annular gear region E, the bearing ring 4 has a further axial groove 18 of rectangular cross-section, at its outside periphery. A receiving bore 19 is associated with the axial groove 18, in the bottom of the bore 15 in the casing. A spring illustrated in the form of a hairpin spring 20 is held in the receiving bore 19. The spring 20 projects into the axial groove 18 and radially loads the bearing ring 4 in such a way that the teeth of the annular gear 3 are pressed against each other with the tips of the teeth thereof, in the engagement-free annular gear region E. That loading direction substantially corresponds to the direction of movement which the bearing ring 4 performs as a consequence of the pivotal movement about the pivot axis 16, 17. The force of the hairpin spring 21 can be kept relatively low as it only serves to ensure the necessary sealing contact between the tips of the teeth in the engagement-free annular gear region E, in the phase of operation when starting the internal-gear pump, that is to say at a time when there is still no operating pressure built up in the pressure chamber D, and therefore no pressure forces are yet acting.

The position and direction of the resultant R is substantially predeterminable and substantially corresponds to that shown in FIG. 1. The build-up of pressure in the pressure chamber D can be influenced in known manner by pre-filling slots at the teeth of the pinion 2 and/or the annular gear 3 so that for example there is a substantially equal pressure over the gaps between the teeth in the pressure chamber D. In that case the resultant R is disposed perpendicularly to the line shown in solid line in FIG. 1 and which connects the apex point of the engagement-free annular gear region E to the pinion tooth at full engagement into a gap between the teeth of the annular gear.

Reference will now be made to FIGS. 3 through 18 showing embodiments of the internal-gear machine according to the invention illustrated in the form of a pump which, unlike the above-described embodiment of FIGS. 1 and 2, have axial plates or disks which bear sealingly against the ends of the respective tooth configurations of the pinion and the annular gear. It will be noted however that the co-operation of the pinion and the annular gear, the mounting thereof in a bearing ring and the mobility thereof relative to the bore in the casing are the same as the corresponding aspects of the construction shown in FIGS. 1 and 2 and therefore do not need to be especially described again here.

Figure 4:
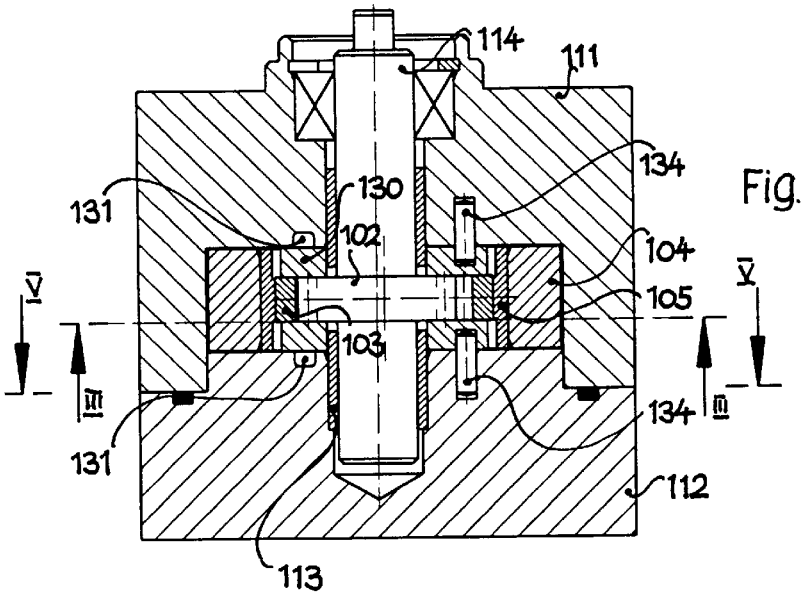
FIG. 4 is a view in axial section taken along line IV—IV in FIG. 3.
Figure 5:
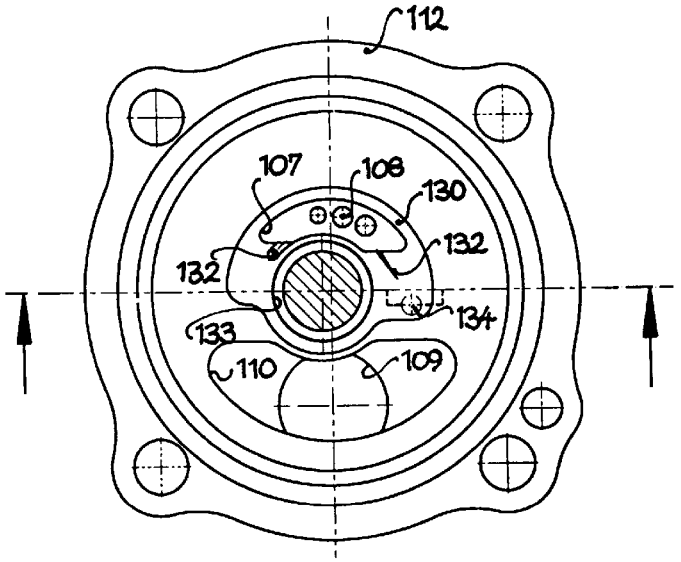
FIG. 5 is an inside view of the casing cover, taken in section along line V—V in FIG. 4, illustrating the associated axial plate or disk.

Referring to FIGS. 3 through 5 the embodiment illustrated therein of the internal-gear pump according to the invention has a pinion shaft 114 which is mounted both in a cup-shaped casing portion 111 and also in a casing cover 112 by way of mounting bushes 113. At its inside periphery the bearing ring 104 has a running ring 105 which is pressed therein and which consequently forms a unit with the bearing ring 104. The ring 105 comprises a bearing metal, for example bronze, and the annular gear 103 is supported therein. As can be seen from FIG. 4 the bearing ring 104 and the running ring 105 considerably exceed the width of the pinion 102 and the annular gear 103 and bear with their faces displaceably against the wall surfaces of the casing portion 111 and the cover 112 respectively. In contrast a respective axial plate or disk 130, the shape of which can be seen from FIG. 5, bears sealingly against the end faces of the tooth configurations of the pinion 102 and the annular gear 103 at each side thereof. Each of the two axial plates or disks 130 has a pressure area 107 on its surface which is towards the respective tooth configurations. In the region of the pressure area 107 the axial plate or disk 130 which is arranged on the side of the casing cover 112 has three openings 108 which lead from the pressure chamber to the pressure outlet passage (not shown) in the casing cover 112. Diametrally opposite to the pressure outlet passage the casing cover 112 has a suction inlet passage 109 which increases in size at its intake mouth opening to form a suction area 110. Indicated in the wall of the casing portion 111 and the casing cover 112 respectively is a respective pressure area 131 by which the respective axial plate or disk 130 is acted upon from the exterior, against the action of the inner pressure area 107, in such a way that the axial plate or disk retains its sealing contact with the pinion 102 and the annular gear 103, under all operating conditions. The configuration and mode of operation of the pressure areas on axial plates or disks are known in this relevant context and therefore do not need to be described in greater detail at this point.

On the surface which is towards the tooth configurations of the pinion and the annular gear the axial plates or disks 130 have pre-filling slots 132 by which the distribution of pressure in the pressure chamber of the tooth arrangement is controlled. For the purposes of securing it in position each axial plate or disk 130 is supported on the one hand by way of the periphery of a mounting bore 133 on the associated mounting bush 113 and on the other hand against a pin 134 which is fitted in the casing portion 111 and the casing cover 112 respectively. The pins 134 each project into a blind bore in the outer end face of the axial plates or disks 130 and are thereby axially held in position.

Figure 6:
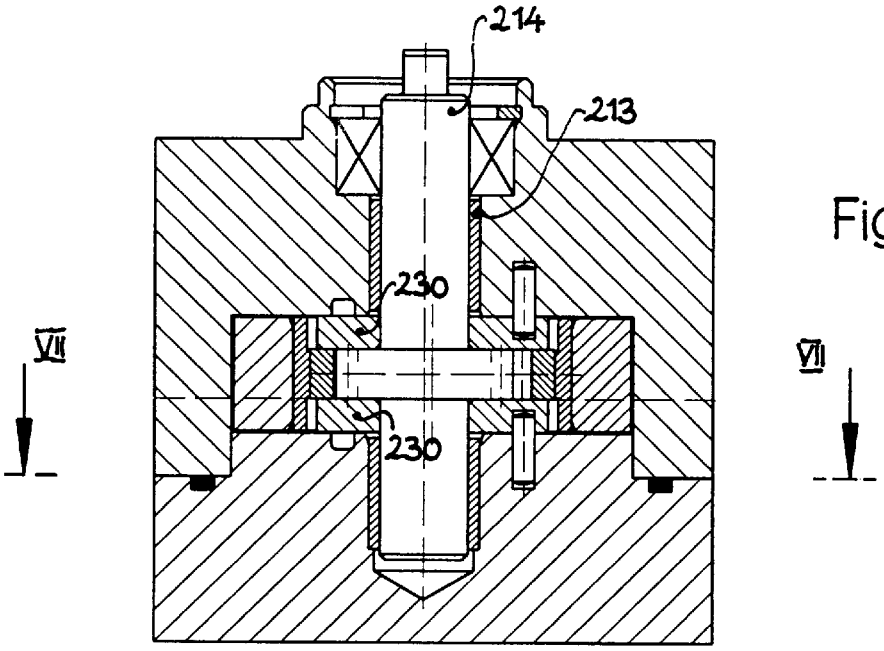
FIG. 6 is a view of a third embodiment of a pump according to the invention in an axial section similarly to FIG. 4.
Figure 7:
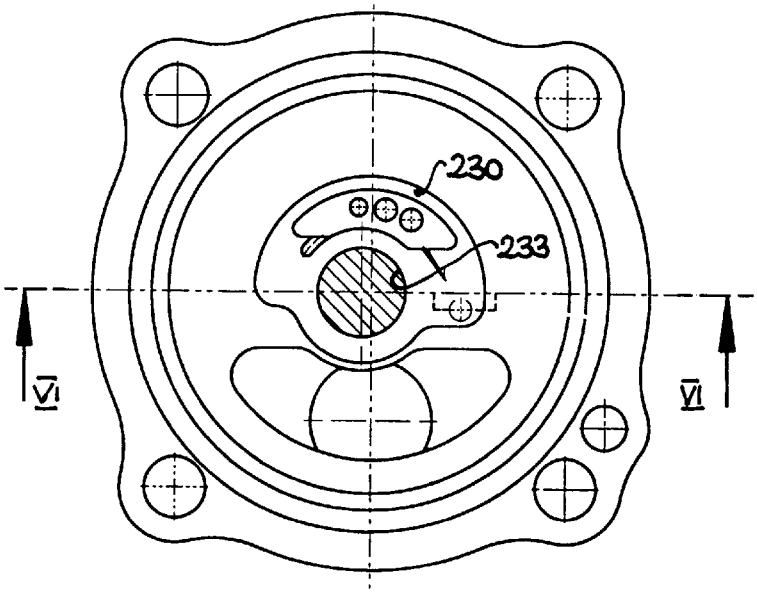
FIG. 7 is an inside view of the casing cover in section taken along line VII—VII in FIG. 6, corresponding to FIG. 5.

Referring now to FIGS. 6 and 7, the embodiment illustrated therein differs from that shown in FIGS. 3 through 5 only in that the axial plates or disks 230 are not supported with the-inside periphery of their mounting bore 233 on the respectively associated mounting bush 213, but directly on the pinion shaft 214. The bushes 213 thus terminate short of the axial disks or plates 230.

In the embodiment shown in FIGS. 8 and 9 the axial disks or plates 330 are approximately of a sickle-like shape and extend around the associated mounting bushes 313 without being supported thereon. To secure them in position, in this case the arrangement has two pins 334 and 335 for each axial plate or disk 330. The pins 334, 335 respectively engage in the end regions of the axial plates or disks 330 into a blind bore on the one hand and into a corresponding bore in the casing on the other hand. In this embodiment the bushes 313 extend under the axial plates or disks 330 to close to the tooth configurations of the pinion and annular gear.

It will be seen that in the above-described embodiments as illustrated in FIGS. 3 through 9 the axial plates or disks are arranged fixedly relative to the casing. That means that in operation of the internal-gear pump with the movement of the pinion, annular gear and bearing ring relative to the housing, which is caused by operation of the pump, due to the permitted pivotal movement of the bearing ring, the pressure chamber in the tooth configuration also changes its position relative to the pressure areas and control slots provided in the axial plates or disks. As this can inevitably give rise to deviations from the optimum set position, the level of efficiency can be reduced as a consequence. In order to prevent that from occurring, the embodiments shown in FIGS. 10 through 18 provide that the axial plates or disks are disposed in such a way that they are jointly movable together with the pinion, the annular gear and the bearing ring. In that respect, in all cases the axial plates or disks are sufficiently free within the limits of their play, for example bearing play, relative to the pinion shaft, that they can follow the pivotal movement of the bearing ring in order not to impede the desired sealing contact in respect of the tips of the teeth.

Referring now to FIGS. 10 through 12 therefore in the embodiment shown therein the bearing ring 404, on the side at the right in FIG. 11, has at both faces a radial groove 440, the bottom of which is in one plane with the end faces of the tooth configurations of the pinion and the annular gear. The axial plates or disks 430 have at their outer edge a projection portion 441 which projects with play into the groove 440 and is guided therein. The axial plates or disks 430 are supported with the inner periphery of their mounting bore 433, with a certain amount of bearing clearance, on the periphery of the pinion shaft 413. That support arrangement together with the fact that the projection portion 441 is guided in the groove 440 on the other hand provides that each axial disk 430 is coupled to the motion unit consisting of the pinion, the annular gear and the bearing ring, and therefore also performs its movements therewith.

In addition the outer pressure areas 431 associated with the respective pressure area 407 of the axial plates or disks 430 are provided exclusively on the respective outward surface of the axial plates or disks 430. When the bearing ring 404 performs pivotal movements about the mounting pin 416, due to operation of the internal-gear pump, the position of the pressure areas 407, 431 and the control slots 432 relative to the pressure chamber therefore remains substantially unchanged. The running ring 405 which is pressed into the bearing ring 404 is limited to the width of the annular gear.

Figure 13:
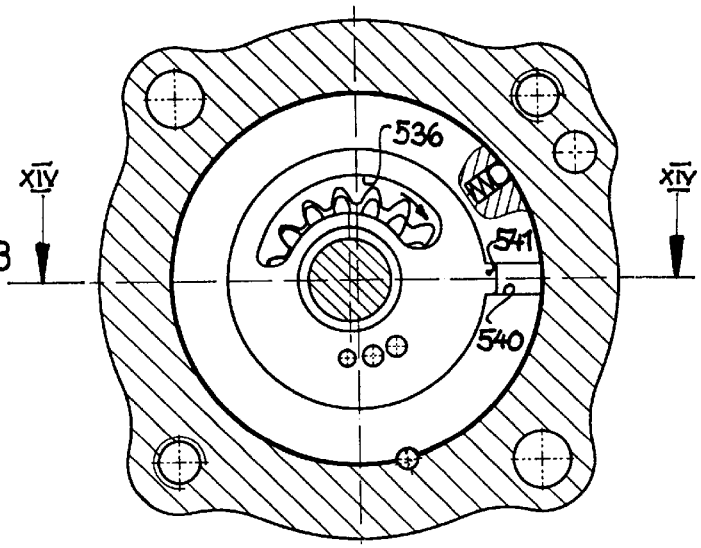
FIG. 13 is a view of a sixth embodiment of a pump according to the invention in cross-section taken along line XIII—XIII in FIG. 14.
Figure 14:
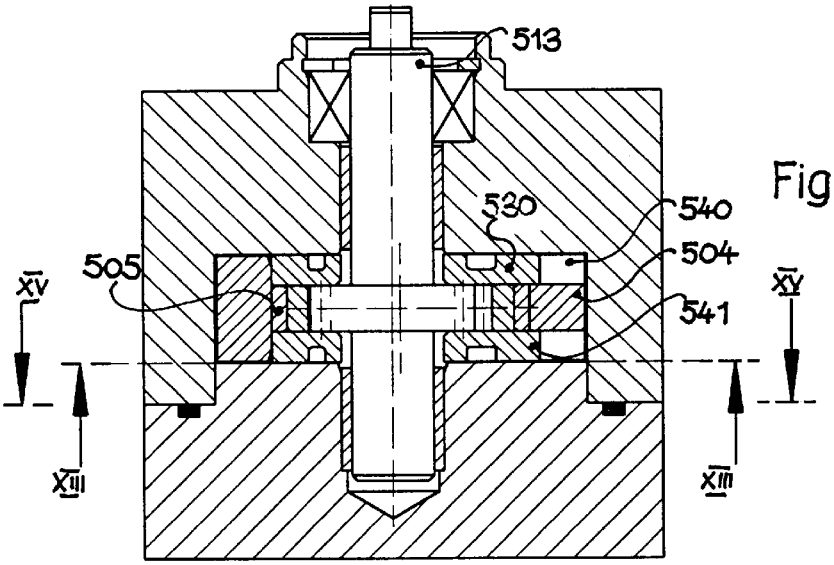
FIG. 14 is a view in axial section taken along line XIV—XIV in FIG. 13.
Figure 15:
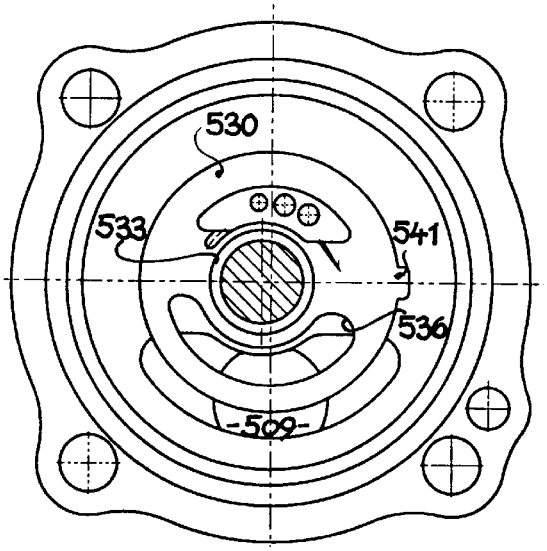
FIG. 15 is a view in cross-section corresponding to FIG. 5 taken along line XV—XV in FIG. 14.

The embodiment shown in FIGS. 13 through 15 differs from the above-described embodiment illustrated in FIGS. 10 through 12 by virtue of the shape of the axial plates or disks as indicated at 530 and the way in which they are secured position. In this case the axial plates or disks 530 have a circular border or edge and are fully accommodated between the pinion and the annular gear on the one hand and the associated casing wall on the other hand, in the space which is afforded by the width of the bearing ring 504 being greater than the annular gear and the pinion. In this case also the width of the running ring 505 which is pressed into the bearing ring 504 is limited to the width of the annular gear. The outside periphery of the axial plates or disks 530 bears snugly against the exposed inside periphery of the bearing ring 504 and has a small projection portion 541 with which the axial plate or disk 530 engages into a radial groove 540 provided on each end face of the bearing ring 504. As the axial plates or disks 530 are held by way of their outside periphery in the bearing ring 504 the periphery of the mounting bore 533 thereof embraces the pinion shaft 513 with a marked clearance in this embodiment.

As in this embodiment the axial plates or disks 530 completely cover over the pinion and the annular gear at the ends thereof, provided in the region of the suction chamber of the tooth arrangement is a part-circular opening 536 which permits a feed flow of the medium to be conveyed out of the suction passage 509 to the tooth arrangement.

Figure 16:
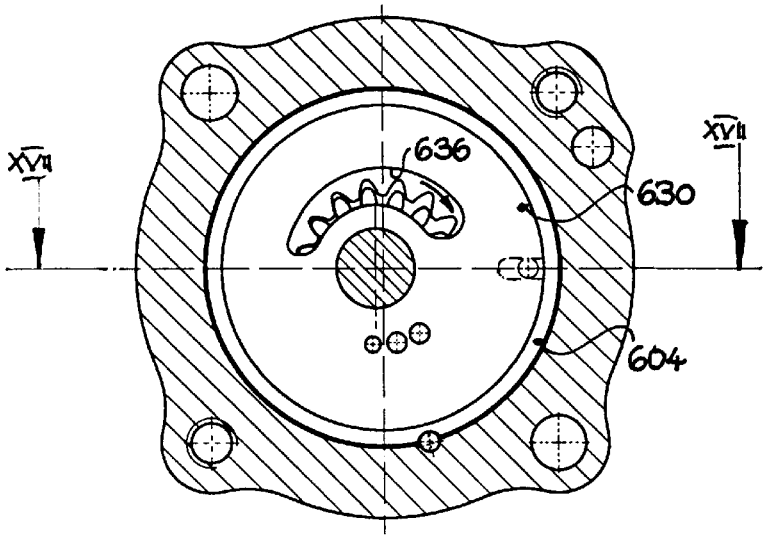
FIG. 16 is a view of a seventh embodiment of a pump according to the invention in cross-section taken along line XVI—XVI in FIG. 17.
Figure 17:
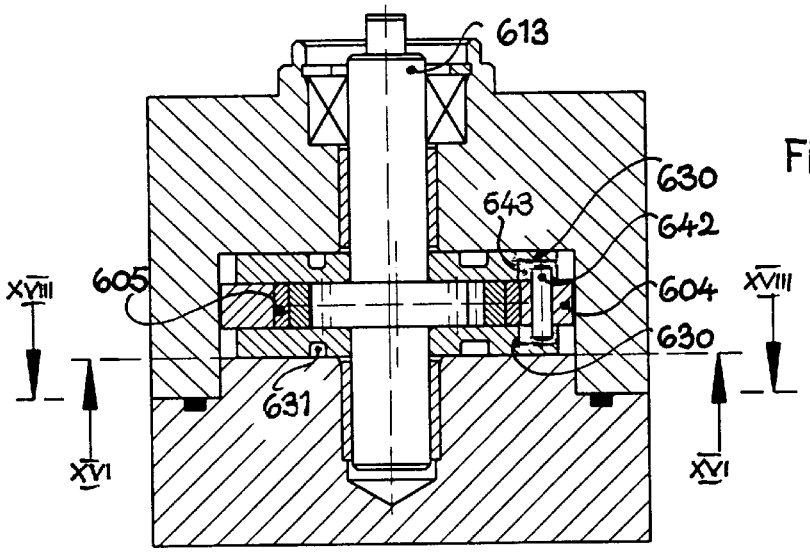
FIG. 17 is a view in axial section taken along line XVII—XVII in FIG. 16.
Figure 18:
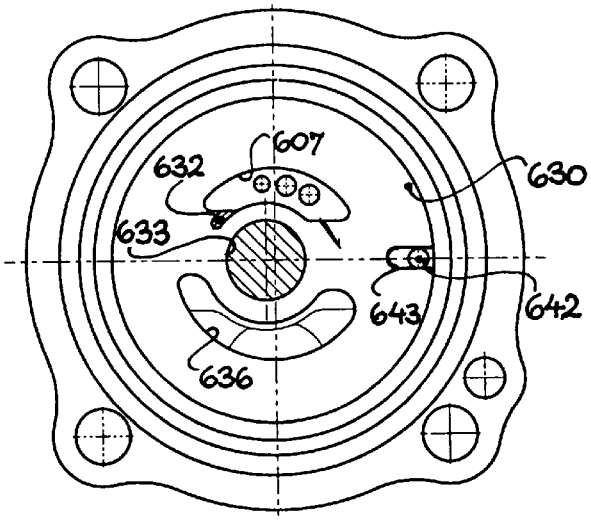
FIG. 18 is a cross-section corresponding to FIG. 5 taken along line XVIII—XVIII in FIG. 17.

Reference will now be made to FIGS. 16 through 18 showing an embodiment in which the axial plates or disks 630 are also circular, but they are of such a large outside diameter that they extend beyond the annular gear and over the bearing ring 604 at the faces thereof. For that purpose the width of the bearing ring 604 together with the running ring 605 which is a press fit therein is limited to the width of the annular gear and the pinion. In order once again to make the axial plates or disks 630 a part of the motion unit consisting of the pinion, the annular gear and the bearing ring, the bearing ring 604 has a bore which extends axially therethrough and in which a pin 642 is accommodated. The pin 642 projects at both ends beyond the faces of the bearing ring 604 and into slots 643 in the axial plates 630. In this case the axial plates or disks 630 are supported with the inside periphery of their mounting bore 633 with a narrow bearing clearance, on the pinion shaft 613. By virtue of that arrangement and by virtue of the pin 642, they are coupled to the bearing ring 604 for unitary movement therewith. As in the above-described embodiments shown in FIGS. 10 through 15 therefore the relative position of the control slots 632 and the pressure areas 607 and 631 respectively with respect to the tooth arrangement is retained. In this case also in the region of the suction chamber the axial plates or disks 630 have an opening 636 to afford access for the medium to be conveyed.

It will be appreciated that the invention is not limited to the configurations of the internal-gear machine or unit such as a pump in accordance with the above-described specific embodiments as illustrated in the drawing. Thus it is in principle possible to adopt a trochoidal or cycloidal tooth configuration, instead of an involute tooth configuration with rounded tooth tips used for the pinion and the annular gear. Further an axial groove corresponding to the axial groove for the pivot axis can also be provided at the bearing ring in mirror image relationship with respect to the separating line A (FIG. 1), for the situation where the internal-gear unit is to be designed for the pinion 2 to rotate in both directions. In that case the mounting pin defining the pivot axis is arranged in a correspondingly displaced position in the casing. Finally the grooves in the faces of the bearing ring (see FIGS. 10 and 13) do not have to pass radially through the peripheral surface thereof, which is only preferred for the sake of simplifying manufacture, but they can be recesses which are restricted to the inside periphery thereof. The position of the projection and the recess may also be interchanged in order to produce the required positively locking connection between the axial plate or disk and the bearing ring.

It will be further noted that although all the above-described embodiments having axial plates or disks comprise two thereof, it is in principle possible for the machine according to the invention to have only one axial plate or disk, in which case any control slots and pressure areas that are possibly required are to be provided directly in the wall of the casing, against which the pinion and the annular gear bear at the respective ends thereof. Finally the pivot axis for the bearing ring, which is described and illustrated throughout as being in the form of a pin, can also be in the form of a ball accommodated in a part-spherical recess in the bore in the casing. That arrangement provides that the bearing ring is pivotable not only about a pivot axis which is parallel to the axis of the pinion, but also in all directions in order to be able to execute movements for adaptation to configurational variations in the individual components involved.

It will be appreciated that still further modifications and alterations may be made in the illustrated constructions without thereby departing from the spirit and scope of the invention.

What is claimed is:

1. A filling member-less internal-gear machine comprising a casing having a bore, the bore defining a bore axis, a bearing ring accommodated in the bore in the casing movably transversely with respect to the bore axis but non-rotatably, the bearing ring defining a ring axis, an internally toothed annular gear mounted rotatably in the bearing ring, a pinion, means rotatably mounting the pinion in the casing, the pinion having teeth meshing with the annular gear by full sealing engagement into gaps between the teeth of the annular gear on one hand and having further sealing contact with the tips of a predetermined number of the teeth of the annular gear in an engagement-free annular gear region which is approximately diametrally opposite the engagement into the gaps between the teeth on the other hand, sealing walls in sealing engagement with the opposite axial ends of said pinion and annular gear, thereby defining a suction chamber and a pressure chamber between said full sealing engagement and said further sealing contact, prefilling slots in at least one of said sealing walls adjacent to the teeth of at least one of the pinion and the annular gear in said pressure chamber, thereby equalizing fluid pressure over the pressure chamber such that a force resultant of pressure forces acting in the pressure chamber on the annular gear is at least approximately perpendicular to a line connecting said full sealing engagement and said further sealing contact teeth, means for pivotal movement of the bearing ring relative to the bore about a pivot axis which is parallel to the ring axis, the pivot axis being arranged in such a wan that a turning moment is generated by said force resultant so as to move the ring portion of the bearing ring which is associated with said engagement-free annular gear region at least approximately radially towards the axis of the pinion, thereby maintaining said further sealing contact.

2. An internal-gear machine as set forth in claim 1 wherein said pivot axis is disposed on the side of the pressure chamber between the line of the resultant of the pressure forces and the ring portion of the bearing ring which is associated with said engagement-free annular gear region.

3. An internal-gear machine as set forth in claim 2 wherein said pivot axis is disposed closer to the line of the resultant than to the ring portion which is associated with said engagement-free annular gear region.

4. An internal-gear machine as set forth in claim 1 wherein said pivot axis is arranged at the outside periphery of the bearing ring.

5. An internal-gear machine as set forth in claim 1 wherein said means for pivotal movement of the bearing ring about said pivot axis comprise a mounting pin fixed with respect to the casing and an axial groove in the outside peripheral surface of the bearing ring in which said mounting pin is partially accommodated.

6. An internal-gear machine as set forth in claim 1 including means for spring-loading radially towards the pinion shaft said ring portion associated with said engagement-free annular gear region.

7. An internal-gear machine as set forth in claim 6 wherein said ring portion associated with the engagement-free annular gear region has a recess at the outside periphery, and further including a spring which is supported on the casing and which engages into said axial groove.

8. An internal-gear machine as set forth in claim 1 including at least one axial plate bearing against the end faces of the tooth arrangements of the pinion and the annular gear, thereby to seal off said pressure chamber.

9. An internal-gear machine as set forth in claim 8 wherein said axial plate has a mounting bore adapted to support it on the pinion shaft and further including at least one projection adapted to support the axial plate on the casing.

10. An internal-gear machine as set forth in claim 8 including at least two projections supporting said axial plate on the casing.

11. An internal-gear machine as set forth in claim 8 including means for pivotal movement of said axial plate together with the bearing ring and the annular gear relative to the casing.

12. An internal-gear machine as set forth in claim 11 including means for positively lockingly connecting the bearing ring to the axial plate.

13. An internal-gear machine as set forth in claim 12 further including a projection on said axial plate and at least one recess in the bearing ring, the projection engaging into said at least one recess.

14. An internal-gear machine as set forth in claim 13 and including a plurality of said projections and a plurality of said recesses, each projection having associated therewith a separate recess in the bearing ring.

15. An internal-gear machine as set forth in claim 13 wherein the projection is guided with play in the recess in the bearing ring and the axial plate has a mounting bore adapted to support it on the pinion shaft.

16. An internal-gear machine as set forth in claim 11 wherein said axial plate is circular and is accommodated with its outside periphery in the bearing ring.

17. An internal-gear machine as set forth in claim 11 wherein said axial plate is circular and is supported on the associated end face of the bearing ring and has a mounting bore adapted to support it on the pinion shaft.

18. An internal-gear machine as set forth in claim 17 including means for positively lockingly connecting the axial plate to the bearing ring.

19. An internal-gear machine as set forth in claim 18 wherein said positively locking connecting means includes a bore in the bearing ring, a slot in the axial plate, and a pin engaging into said bore in the bearing ring and into said slot in the axial plate.

20. An internal-gear machine as set forth in claim 8 and comprising first and second axial plates bearing against respective end faces of said pinion and said annular gear.

* * * * *

UNITED STATES PATENT AND TRADEMARK OFFICE

CERTIFICATE OF CORRECTION

PATENT NO. : 6,074,189

DATED : June 13, 2000

INVENTOR(S) : Otto Eckerle

It is certified that error appears in the above-indentified patent and that said Letters Patent is hereby corrected as shown below:

Column 6, line 59, now reads: "the hairpin spring 21"
should be: --the hairpin spring 20--.

Signed and Sealed this

Third Day of April, 2001

*Attest:*

Nicholas P. Godici

NICHOLAS P. GODICI

*Attesting Officer*

*Acting Director of the United States Patent and Trademark Office*